US007183478B1

(12) United States Patent
Swearingen

(10) Patent No.: US 7,183,478 B1
(45) Date of Patent: Feb. 27, 2007

(54) DYNAMICALLY MOVING NOTE MUSIC GENERATION METHOD

(76) Inventor: Paul Swearingen, 3448 Hickerson Dr., San Jose, CA (US) 95127

( * ) Notice: Subject to any disclaimer, the term of this patent is extended or adjusted under 35 U.S.C. 154(b) by 161 days.

(21) Appl. No.: 10/914,058

(22) Filed: Aug. 5, 2004

(51) Int. Cl.
*A63H 5/00* (2006.01)
*G04B 13/00* (2006.01)
*G10H 7/00* (2006.01)

(52) U.S. Cl. ..... 84/609; 84/615; 84/649; 84/653

(58) Field of Classification Search ..... None
See application file for complete search history.

(56) References Cited

U.S. PATENT DOCUMENTS 4,217,804 A 8/1980 Yamaga et al.
4,379,420 A * 4/1983 Deutsch ..... 84/619
4,708,046 A 11/1987 Kozuki
4,716,804 A 1/1988 Chadabe
5,281,754 A 1/1994 Farrett
5,357,048 A 10/1994 Sgroi
5,375,501 A 12/1994 Okuda
5,406,020 A 4/1995 Imaizumi
5,418,322 A 5/1995 Minamitaka
5,424,486 A 6/1995 Aoki
5,451,709 A 9/1995 Minamitaka
5,488,196 A 1/1996 Zimmerman
5,496,962 A 3/1996 Meier
5,502,274 A 3/1996 Hotz
5,612,501 A 3/1997 Kondo
5,619,003 A 4/1997 Hotz
5,714,705 A 2/1998 Kishimoto
5,739,453 A 4/1998 Chihana
5,783,767 A * 7/1998 Shinsky ..... 84/657
5,864,079 A 1/1999 Matsuda
5,883,325 A 3/1999 Peirce
6,201,178 B1 * 3/2001 Shinsky ..... 84/613
6,245,984 B1 6/2001 Aoki
6,448,486 B1 * 9/2002 Shinsky ..... 84/613
6,639,141 B2 10/2003 Kay
6,642,444 B2 11/2003 Hagiwara
6,683,241 B2 1/2004 Wieder
6,696,631 B2 2/2004 Smith
6,979,767 B2 * 12/2005 Georges et al. ..... 84/609
2004/0089141 A1 * 5/2004 Georges et al. ..... 84/609

* cited by examiner

*Primary Examiner*—Marlon Fletcher

(57) ABSTRACT

A dynamically moving method of triggering musical notes that produces intricate, interwoven note sequences with ease as an aid to musicians. Notes that used to stand still while being played can now effectively move. Note events are programmed to generate or trigger positive or negative jumps in intervals of frequency relative to their current frequencies. Subsequent notes are referenced to each new current frequency on a note-by-note basis. Music controller interval producing events are arranged across the playing surface in helpful ways (12, 14, 16). The triggered notes may be artificially generated, instead of played by a musician. Using this technique complex, beautiful music can be coherently and easily produced. The technique generates a moving reference that may be applied to other useful musical functions. For instance, an input note event can silently move the reference to a new location. An input note event can also repeat the last interval, whatever it was. An input note event can further play a note relative to the current reference. The musician may weave in and out of tables that remap said interval values and other note functions, including complex chord production.

11 Claims, 12 Drawing Sheets

Keyboard Layout Example
Interval Notes Centered At Key D

Functions Table

Highest Input Note Octave

| | | | | | | | | | | | | |
|---|---|---|---|---|---|---|---|---|---|---|---|---|
| 10 | S | S | S | S | S | S | S | S | | | | |
| 9 | S | S | S | S | S | S | S | S | S | S | S | S |
| 8 | F I | F I | F I | F I | F I | F I | F I | F I | F I | F I | F I | F I |
| 7 | F I | F I | F I | F I | F I | F I | F I | F I | F I | F I | F I | F I |
| 6 | F I | F I | F I | F I | F I | F I | F I | F I | F I | F I | F I | F I |
| Middle C 5 | I | I | I | I | I | I | I | I | I | I | I | I |
| 4 | I | I | R I | I | I | I | I | I | I | I | I | I |
| 3 | I | I | I | I | I | I | I | I | I | I | I | I |
| 2 | S | S | S | S | S | S | S | S | S | S | S | S |
| 1 | S | S | S | S | S | S | S | S | S | S | S | S |
| 0 | S | S | S | S | S | S | S | S | S | S | S | S |

Lowest Input Note Octave

S = Still
I = Interval
F I = Follow Interval
R I = Repeat Last Interval

Dark Lines Shown For Clarity 18 16 12 14

FIG. 3

Offsets Table

Numbers in base 12

| | | | | | | | | | | | | |
|---|---|---|---|---|---|---|---|---|---|---|---|---|
| 10 | 60 | 61 | 62 | 63 | 64 | 65 | 66 | 67 | | | | |
| 9 | 50 | 51 | 52 | 53 | 54 | 55 | 56 | 57 | 58 | 59 | 5a | 5b |
| 8 | 20 | 21 | 22 | 23 | 24 | 25 | 26 | 27 | 28 | 29 | 2a | 2b |
| 7 | 10 | 11 | 12 | 13 | 14 | 15 | 16 | 17 | 18 | 19 | 1a | 1b |
| 6 | 0 | 1 | 2 | 3 | 4 | 5 | 6 | 7 | 8 | 9 | a | b |
| Middle C 5 | a | b | 10 | 11 | 12 | 13 | 14 | 15 | 16 | 17 | 18 | 19 |
| 4 | -2 | -1 | 0 | 1 | 2 | 3 | 4 | 5 | 6 | 7 | 8 | 9 |
| 3 | -12 | -11 | -10 | -b | -a | -9 | -8 | -7 | -6 | -5 | -4 | -3 |
| 2 | 40 | 41 | 42 | 43 | 44 | 45 | 46 | 47 | 48 | 49 | 4a | 4b |
| 1 | 30 | 31 | 32 | 33 | 34 | 35 | 36 | 37 | 38 | 39 | 3a | 3b |
| 0 | 20 | 21 | 22 | 23 | 24 | 25 | 26 | 27 | 28 | 29 | 2a | 2b |

Dark Lines Shown For Clarity

20

FIG. 4

| | | | | | | | | | | | | |
|---|---|---|---|---|---|---|---|---|---|---|---|---|
| 10 | 0 | 0 | 0 | 0 | 0 | 0 | 0 | 0 | | | | |
| 9 | 0 | 0 | 0 | 0 | 0 | 0 | 0 | 0 | 0 | 0 | 0 | 0 |
| 8 | 1 | 1 | 1 | 1 | 3 | 3 | 3 | 3 | 3 | 6 | 6 | 6 |
| 7 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| Middle C 5 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 2 | 8 | 8 | 8 | 8 | 4 | 4 | 4 | 4 | 4 | 4 | 4 | 56 |
| 1 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 |

| | | | | | | | | | | | | |
|---|---|---|---|---|---|---|---|---|---|---|---|---|
| 10 | N3 | N3 | N3 | N3 | N3 | N3 | N3 | N3 | | | | |
| 9 | N1 | N1 | N1 | N1 | N1 | N1 | N1 | N1 | N1 | N1 | N1 | N1 |
| 8 | C2 | C2 | C2 | C2 | C2 | C2 | C2 | C2 | C2 | C2 | C2 | C2 |
| 7 | N1 | N1 | N1 | N1 | N1 | N1 | N1 | N1 | N1 | N1 | N1 | N1 |
| 6 | N1 | N1 | N1 | N1 | N1 | N1 | N1 | N1 | N1 | N1 | N1 | N1 |
| Middle C 5 | N1 | N1 | N1 | N1 | N1 | N1 | N1 | N1 | N1 | N1 | N1 | N1 |
| 4 | N1 | N1 | N1 | N1 | N1 | N1 | N1 | N1 | N1 | N1 | N1 | N1 |
| 3 | N1 | N1 | N1 | N1 | N1 | N1 | N1 | N1 | N1 | N1 | N1 | N1 |
| 2 | C7 | C7 | C7 | C7 | C7 | C7 | C7 | C7 | C7 | C7 | C7 | C7 |
| 1 | N2 | N2 | N2 | N2 | N2 | N2 | N2 | N2 | N2 | N2 | N2 | N2 |
| 0 | N1 | N1 | N1 | N1 | N1 | N1 | N1 | N1 | N1 | N1 | N1 | N1 |

Output Synths Table

26

Highest Input Note Octave

| | | | | | | | | | | | | |
|---|---|---|---|---|---|---|---|---|---|---|---|---|
| 10 | 0 | 0 | 0 | 0 | 0 | 0 | 0 | 0 | | | | |
| 9 | 0 | 0 | 0 | 0 | 0 | 0 | 0 | 0 | 0 | 0 | 0 | 0 |
| 8 | 3 | 3 | 3 | 3 | 8 | 8 | 8 | 8 | 8 | 8 | 8 | 8 |
| 7 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| Middle C 5 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 2 | 6 | 6 | 6 | 6 | 6 | 6 | 6 | 6 | 6 | 6 | 6 | 6 |
| 1 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 |

Dark Lines Shown For Clarity

Lowest Input Note Octave

FIG. 7

These Select Which Chord Notes Go To Which Synthesizers

Synths Table

32

| Output Chan: | 1 | 2 | 3 | 4 | 5 | 6 | 7 | 8 | 9 | 10 | 11 | 12 |
|---|---|---|---|---|---|---|---|---|---|---|---|---|
| Patch | 0 | 4 | 8 | 32 | 89 | 0 | 88 | 90 | 4 | 3 | 2 | 84 |
| Hi Bank | 0 | 0 | 0 | 0 | 0 | 0 | 0 | 0 | 0 | 0 | 0 | 0 |
| Lo Bank | 0 | 0 | 1 | 2 | 2 | 2 | 2 | 1 | 1 | 0 | 0 | 0 |
| Hi Note | 127 | 100 | 127 | 127 | 127 | 127 | 127 | 127 | 127 | 127 | 127 | 127 |
| Lo Note | 0 | 30 | 35 | 0 | 0 | 0 | 0 | 0 | 0 | 0 | 0 | 0 |
| Volume | 127 | 80 | 60 | 80 | 80 | 120 | 80 | 90 | 127 | 127 | 127 | 50 |
| Pan | 64 | 64 | 80 | 0 | 64 | 64 | 80 | 70 | 40 | 63 | 64 | 64 |

• • •

FIG. 10

Function Decoding Flow Diagram B

Output Decoding Flow Diagram

High Level Program Flow Diagram

DYNAMICALLY MOVING NOTE MUSIC GENERATION METHOD

FEDERALLY SPONSORED RESEARCH not applicable

SEQUENCE LISTING OR PROGRAM not applicable

BACKGROUND

1. Field of Invention

The present invention relates to the production of dynamically moving musical note sequences while playing electronic musical instruments.

2. Description of Prior Art

Traditional musical instruments use stationary notes that keep sounding the same note over and over when played. For instance, a piano has 88 notes that all operate in a stationary manner. Each a the key is pressed, the same note is produced, repeatedly. Electronic keyboard organs and synthesizers use a similar type of technology of producing the same note each time a key is pressed. It is often possible to change the entire musical key of the instrument, which shifts the note outputs. As an example, a middle C doesn't produce a C any more, but produces another note with surrounding notes shifted accordingly, relative in frequency to the C. Using this technique the musical key of smaller selectable sections of the keyboard can also be shifted. Traditionally, this technique requires setting the musical key using a keyboard control button. The setting of the new musical key doesn't generate a note, but simply adjusts a range of subsequently played notes. After the musical key is adjusted, the musician plays the keyboard in the conventional manner.

Often times there is internal or external software or hardware that remaps the notes to produce various note ranges along the keyboard span. For many years software has been available that remaps the notes on various instruments. Sequencer programs that record and edit multiple tracks of a song have available that perform extensive remapping of notes and that can produce elaborate chords.

For years instruments have also delivered the capability of generating arpeggios that are chord notes that automatically sequence through as various notes are held down. Using hardware and/or software, they cycle through the held down notes using various patterns and timing. This often creates mechanical sounding arpeggios. Another technique is to have various sequences of notes or chords stored in memory and play them automatically while the musician harmonizes with them, or plays other melodic notes at the same time. Here again, there can be a "canned" mechanical sound to the computer generated sequences. Often times there are entire songs recorded into memory that manufacturers have provided for the musician to play along and harmonize with.

The above mentioned techniques are often used with other electronic instruments, such as electronic guitars, drums, or clarinet type controllers, just to mention a few. These instruments often produce what is called a MIDI, which stands for Musical Instrument Digital Interface, output through a port, which generates a 31.25 thousand bits per second serial stream of digital data. This stream encodes the note number, note velocity, and note on or note off event to be sent to external synthesizers or computers, among a host of other MIDI functions. These other functions can contain pitch bend, sustain, and volume commands, just to name a few.

The most closely applicable portions of the prior art have offered a wide assortment of extremely commendable techniques used to alter the pitch of musical output notes in very creative ways. However, none of previous techniques use the powerful, specific, completely user controlled, input note triggering source of the present invention. In past inventions, arpeggio note values are generated using various algorithms and placed in pattern tables or shift registers to be automatically cycled through while various notes are pressed. The present invention uses no such pattern tables to cycle through. It uses the playing surface, itself, to generate patterns of moving notes and the musician directly produces the sequencing based upon the specific played input notes, rather than using any internally cycled pattern tables. This is a huge distinction. The input notes may be assigned to index into interval producing tables while being played. The tables are judiciously set up ahead of time by the musician, who subsequently generates the final output sequences, on a note-by-note basis. Moving note or arpeggio variations are created by the musician during a performance based upon the variable interval producing events assigned to the playing surface notes, rather than being stored in pattern tables. Since no pattern tables are used, the musician has ultimate control over the output timing and output note values, since each note or chord played is chosen and triggered, intelligently, on-the-fly.

OBJECTS AND ADVANTAGES

One advantage to this interval producing moving note approach is that a musician can almost immediately start playing gorgeous musical arpeggios with ease. What took years of work for people to learn in the past can now be done in a few minutes. Another advantage is that the hands don't have to move all over the keyboard any more. In the past producing intricate, interwoven, note sequences took a lot of talent, effort, and much hand movement to play the complex note sequences. Now this can be powerfully accomplished with the hands moving very little. Subsequently, the hands and arms won't tire as easily. The full back and forth musical span of the output note range can be accomplished with as little as two fingers on one hand. Another advantage is that the musical key can be routinely continuously changing. The musician can weave in and out of effective musical keys as easily as it was to stay in one musical key before the invention. As the musical key dynamically shifts it eliminates the requirement to learn 12 different keyboard patterns. Only one pattern need be learned to provide a unified, elegant solution. As compared to previous approaches that used computer generated arpeggio patterns, another advantage is that all the various timings of the arpeggios and note sequences are completely controlled by the musician and hence emotional content of the music can be fully dictated and enhanced. This is because each note is actually played. Often automatic computer generated timing sounds empty, while this approach doesn't. As a further advantage, the invention much opens up the usefulness of far smaller keyboards and instrument controllers such as electronic drums, since their previous stationary notes tended to confine them to smaller note ranges. A few drum pads that trigger notes or drum events, or a keyboard that is one or two octaves wide can powerfully span the entire range of notes with ease.

SUMMARY

This simple, yet powerful invention allows people to play their electronic musical instruments in delightfully new ways. Notes that have traditionally stood still while being played now dynamically move up or down by various musical intervals, or steps. In the case of a keyboard, when a key is pressed it produces a new note that is a new frequency above or below the last note played. This note position then becomes the new reference for the next note played. The assigned keyboard step quantities can be intelligently arranged in various patterns so simple or complex arpeggios or note sequences can be played with ease. This technique also produces the foundation on which many various key functions can be applied. For instance, a key function may be defined to repeat the last interval jump, whatever it was. Playing other keys can silently move the reference. Also, sections of the keyboard may be defined to operate in a stationary manner, until the musical reference is changed. When the reference changes the sections shift by the updated reference amount, but don't move until the reference is again updated. This is useful for performing real time multiple note chords where one hand generates intervals, while the other hand generates a variety of ever changing chords, with respect to the new moving reference. Using multiple tables opens up the option of powerfully weaving in and out of various tables during play. The functions applied using the tables give the musician ultimate control over the simplicity or the complexity of the playing surface.

DRAWINGS

Brief Description of the Drawings

FIG. 3 shows a table that is used to edit specific note functions that are translated to produce the final output.

FIG. 4 is a table that is used to edit note offsets that are used in conjunction with the note functions of FIG. 3.

FIG. 7 is a table used to associate the FIG. 9 Chord Synthesizer Tables to an output chord, if so desired.

FIG. 10 sets up the output synthesizer patches, banks of patches, high and low limits of notes sent, volume, and pan for each output synthesizer.

REFERENCE NUMERALS IN DRAWINGS

| | | | |
|---|---|---|---|
| 10 | Keyboard | 12 | Interval Producing Notes |
| 14 | Repeat Last Interval | 16 | Follow Interval Producing Notes |
| 18 | Functions Table | 20 | Offsets Table |
| 22 | Chords Table | 24 | Output Type Table |
| 26 | Output Synths Table | 28 | Chord Note Selection |
| 30 | Chord Synthesizer Tables | 32 | Synths Table |

DETAILED DESCRIPTION

Preferred Embodiment

Figure 1:
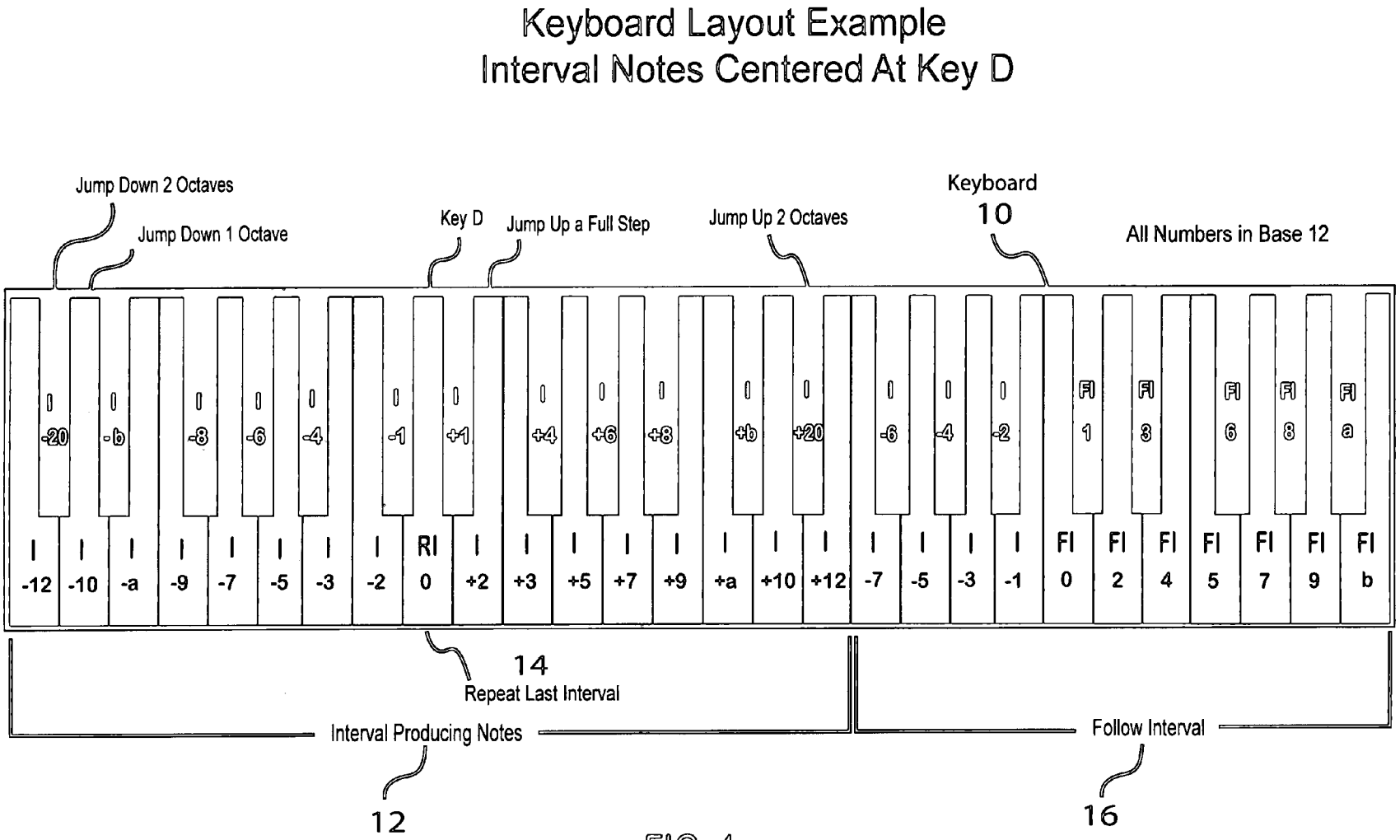
FIG. 1 shows a keyboard layout of a largely equally balanced interval solution mostly using one semitone count variation for each adjacent key. The larger left section produces the intervals, while the right section plays relative to the left section. Centering the interval producing functions at the D key offers a particularly clean, and easy to play balance of intervals. The right section generated notes are shifted up and down based on the musical reference created by the left section of note events.

This invention produces a method of playing notes, whereby they don't stand still anymore, but move up or down by selectable musical intervals. In the case of a keyboard, each time a key is pressed the resultant output note may move up or down with respect to the last output note by a selectable quantity of semitones. Thus, instead of standing still, a played note effectively moves. Each time a note is played, a new shifted pitch is sounded and a new shifted musical reference is obtained to be the starting point for the next note. The new note gets played relative to this new starting point, and so on. As a simple example, refer to FIG. 1. The left-hand portion of notes are labeled "Interval Producing Notes". This figure shows a balanced arrangement of interval step quantities ascending in the right hand direction from the D key, and descending in the left hand direction from the D key. The function of the D will be described later. Each time a key is pressed to the right of the D, a new note is produced that is the shown number quantity of semitones higher than the last note produced. If one were to play the high end D over and over again the note sequence would ascend by octaves. Likewise if one were to play the low end D, the generated note sequence would descend by octaves. Note that the numbering is in base 12, so a count of 10 equals 12 semitones higher and a count of −10 represents a minus 12 semitone interval, count, or offset.

The preferred embodiment gives the musician full flexibility in choosing and assigning functionality of all the musical instrument controller notes. Most musical controllers have what's called a MIDI (Musical Instrument Digital Interface) output that sends note information out in a serial stream of data. There are 7 bits of data that describe each note, hence there are 128 different possibilities. The preferred embodiment has hundreds of each of the shown tables in FIGS. 3–10. They remap the 128 different MIDI notes in various ways to give the musician wide open flexibility in utilizing the new interval producing processes.

One implementation possibility is for the method to be embedded directly inside electronic musical instruments. In this case hardware or software tables store the data that assigns functionality to the notes. MIDI need not be used, as the invention applies to any played, stored, or generated musical input note values used as a source. A second approach is to embed the method inside a hardware device that reinterprets MIDI type events and generates MIDI outputs. A third approach is a software program operated on a computer that gives the musician a powerful user interface. The third software version is operated by providing a path between the musical controller and the output synthesizers. The output synthesizers may be within the computer or external to the computer. In all three cases the basic operation is the same. There are tables that are either filled in by the manufacturer, tables the musician adjusts, or both. Also, for that matter, tables need not be used, but the function events may be calculated on the fly by any processing activity. It is also feasible to use a combination of tables and on the fly processing to come up with the intervals or various functions used.

Figure 2:
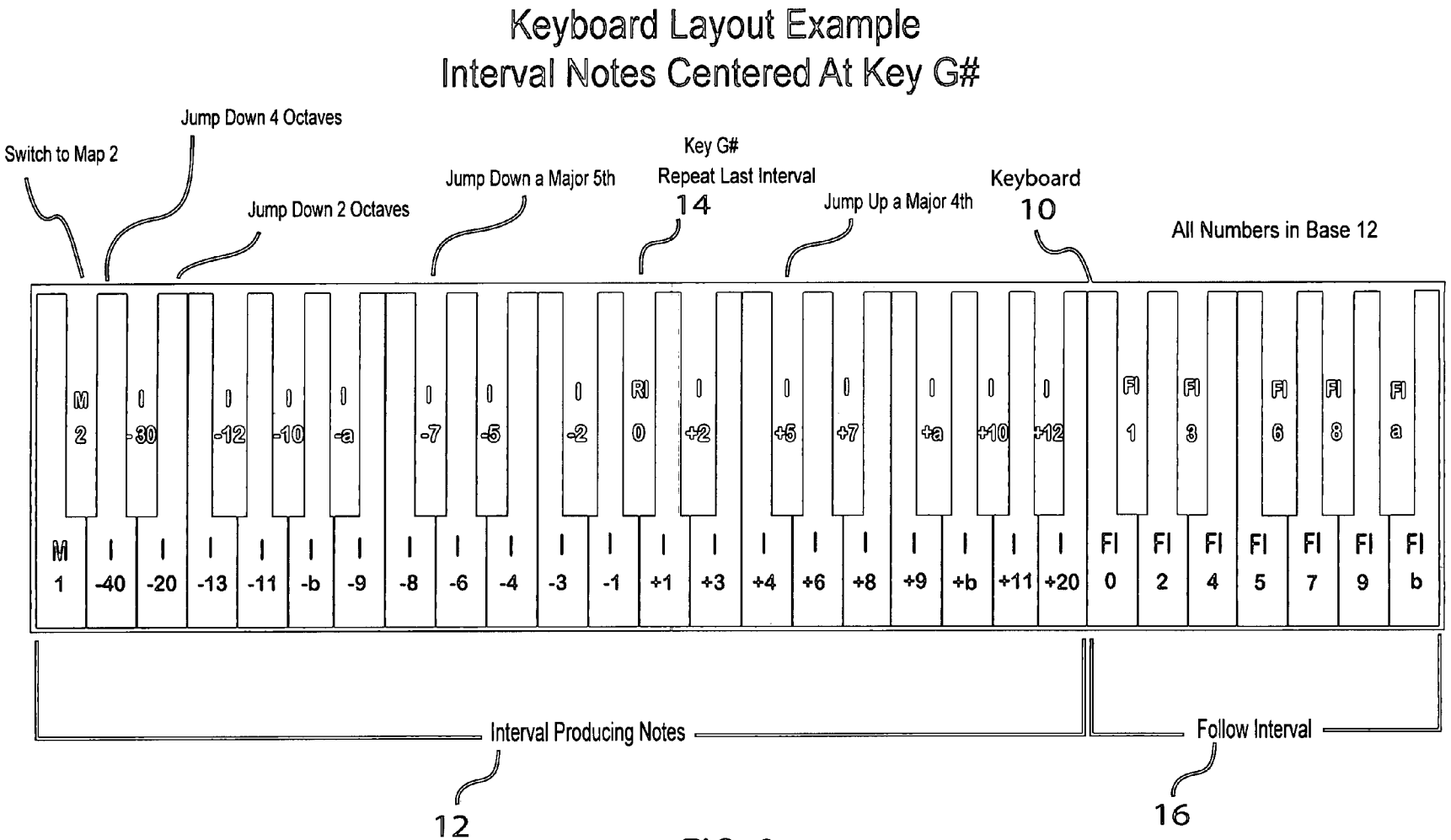
FIG. 2 is another keyboard example showing a different layout of note function possibilities. It is another of thousands of musically beneficial possibilities.
Figure 5:
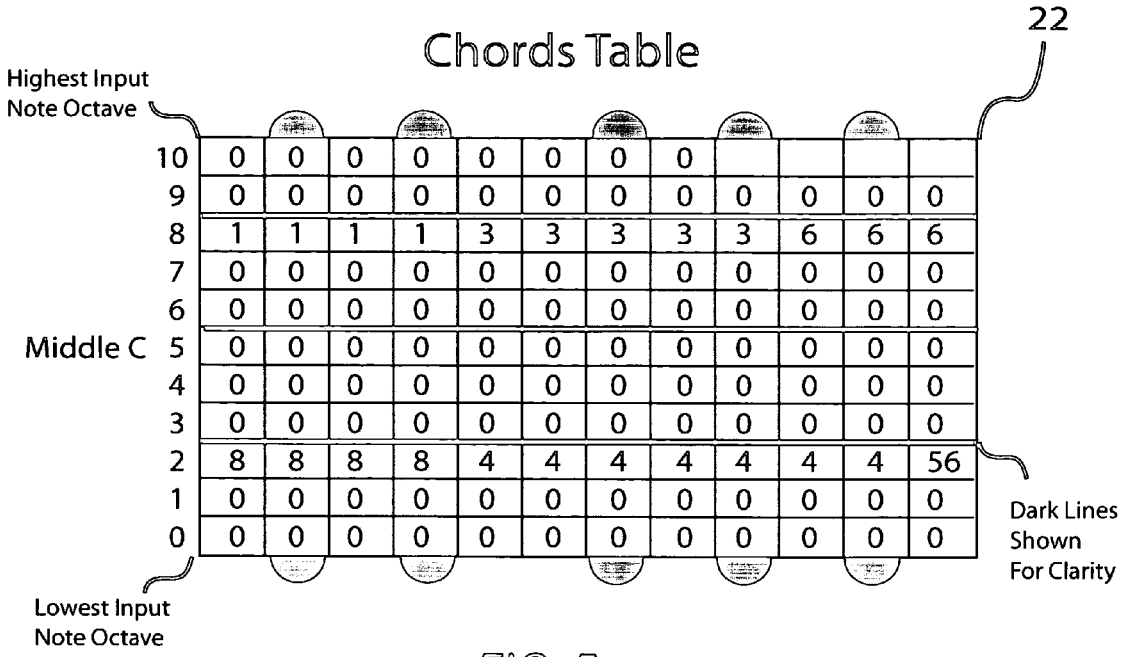
FIG. 5 shows a table used to apply a specific chord to each note that is designed using FIG. 8 and possibly FIG. 9.
Figure 6:
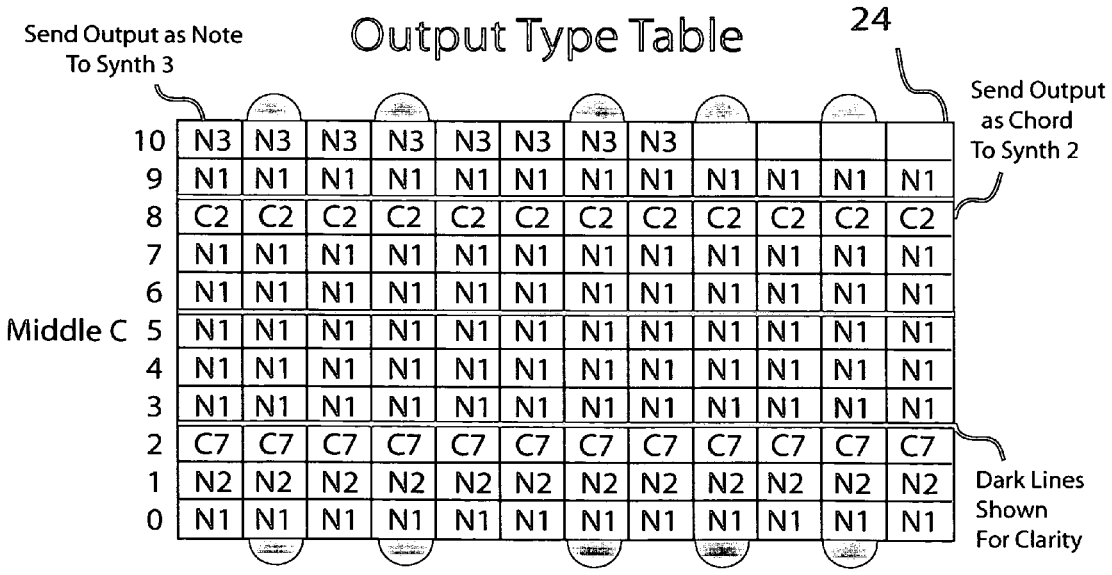
FIG. 6 is a table used to direct the output of each note to any synthesizer as a note, or as a chord.

As an example, shown in FIGS. 3–7, tables 18, 20, 22, 24 and 26 give the musician instant access to various mappings of functionality 18. Notes generated by the MIDI controllers or internally inside the musical instruments are called input notes. These are input notes since they are inputs that point into the software tables to select various functions 18. Each of the 128 positions in the function 18 and offset 20 tables may operate in any of several ways, depending upon how the musician wants the FIG. 1 and FIG. 2 instrument playing surface 10 to operate. Note that the offset 20 numbers are listed in base 12. Using base 12, octaves line up cleanly and are more intuitive to work with. The base 12 "a" and "b" are not related to musical A or B. If all the functions were set to Still, "S", and the note offsets were sequentially set to 0–a7 (base 12), then the keyboard would operate in a traditional manner with each note simply outputting one of 128 still notes.

Viewing tables in FIGS. 3–7, the software table mappings not only include functions 18, but also include offsets 20, chords 22, output type 24, and output synths table 26 selections. The offsets 20 are used in conjunction with the functions 18. The chords 22 select from hundreds of chords for each input note to trigger. They are simply tables similar to the offsets table 20 that give the musician hundreds of numbers to choose from to apply a chord to a note. The output type selections 24 let the user direct notes to individual synthesizers or enable chord production. The output synths table 26 selects which FIG. 9 chord synthesizers 30 are to be used. The functions 18, offsets 20, chords 22, output type 24, and chord synths tables 26 get selected in parallel during normal operation and are all selected by the functional map changes. They are ganged together, so by changing one map number, they all get updated with new data. During the playing process the musician weaves in and out of hundreds of these entire sets of maps. Part of the playing process enables the musician to select new map changes using keys on the keyboard or notes on the controller. The musician can "turn on a dime" at any time and instantly use a new set of tables.

Some of the note functions include:

| Function | Output Note Generated |
|---|---|
| Still | Traditional note operation that stands still, doesn't jump, and plays the same note each time. It uses offset 20 to determine the note pitch. |
| Interval 12 | Produces an upward or downward jump from the last reference played. Sets the reference to the new note pitch. Uses offset 20 to determine how many semitones to step up or down. |
| Follow Interval 16 | Operates like Still, but gets dynamically shifted up and down, depending upon the changing reference produced by any event that updates the reference. Can operate the same way as changing the musical key on conventional controllers. These play the same note over and over again in each new musical key. Offset 20 is used to adjust the output note value relative to the current reference. |
| Repeat Interval 14 | Operates like Interval 12, but repeats last interval jump quantity. The corresponding offset 20 is ignored. |
| Quiet Interval | Same as Interval 12, but doesn't sound an output note. This just changes the reference to a new pitch. |
| Home | This sets the reference to a known "Home" location. The offset 20 selects the desired home location. |
| Map | Select a new entire table mapping of the 128 MIDI note functions 18, offsets 20, output type 24, chords 22, and output synths 26. The offset value 20 determines the new map number. |
| +Map | Select a new entire table mapping of the 128 MIDI note functions 18, offsets 20, output type 24, chords 22, and chord synths 26. The offset 20 adds a positive or negative value to the current map to select the new map. |
| Synths Map | Switches to a new Synths table that selects new synthesizers and sends new patch numbers to the synthesizers used. Uses offset 20 as a value of the new table to use. |
| +Synths Map | Switches to a new synths table that sends new patch numbers to the synthesizers used. Uses offset 20 to add a positive or negative value to the current synths map. |

This list provides a foundation of the functions 18 from which the musician can select during a performance. The tables are edited ahead of time. There are many other possibilities for interacting with the instruments. For instance, the interval need not be a consistent quantity of semitones, but other tables or software patterns may be used to update the interval offset each time a note is played. Also, various output scale tables may be used and selected with other functions 18. Scale tables simply remap all 128 MIDI notes to 128 selectable MIDI notes. For instance, it is easily possible to have all the MIDI notes mapped backwards to create an unusual output note effect. There is a wide range of possibilities for applying various tables to give the musicians wide flexibility in choosing how their music is performed. For instance, one possibility is to cluster the data together in the cells of the tables instead of having separate tables for each data type. Another possibility is to use a music notation style staff to select various intervals, instead of using tables.

The FIG. 10 synths table 32 is used to select various patches for each of the synths. It does this by using the patch number, along with the hi bank and lo bank values. Software limits may be applied to the output notes so that the low and high ends of the output notes won't be sent. This is what the hi note and lo note values are for. Synthesizers often generate incorrect output sounds if the notes feeding them go too far above or below certain MIDI note limits. This depends upon the internal sounds the synthesizers make. The software limits may be included in the Synths tables 32 that get updated depending upon which musical synthesizer patch is selected. Also, various techniques can be applied when the moving interval reference gets too low or high, where the notes jump up or down, or are folded up or down to stay within a specified or varied range. The interval producing functions 18 can also turn around and start operating in a backwards fashion when the upper or lower limits are reached, although this may possibly be confusing to some musicians. The synths table in FIG. 10 also shows that volume and pan may be sent to the synthesizers upon sending a Synths update to the synthesizers.

The invention can also give the musician capability to record multiple tracks of a song using a software sequencer recording technique. The software sequencer isn't shown, because it's beyond the scope of the patent. In this case, individual input note events that take up 4–6 bytes of memory space can be recorded into the tracks of a song. Using this approach the input note events are recorded, then during playback the events feed the said function maps 18 in very powerful ways. Short events consisting of a few bytes can trigger vast chords of hundreds of notes, but these hundreds of notes are not recorded into the song. After a track is recorded, by changing a single number in a recorded map event, the entire operation, sound, and complexity of the song can be completely changed, almost instantly. This is because completely different sets of map tables are selected that may operate entirely differently. They may produce a completely different set of chords sent to a completely different set of synths. The functions 18 may be entirely different, further producing a completely different pattern of sound. The output of the song index into the various tables and they produce the final output.

Figure 8:
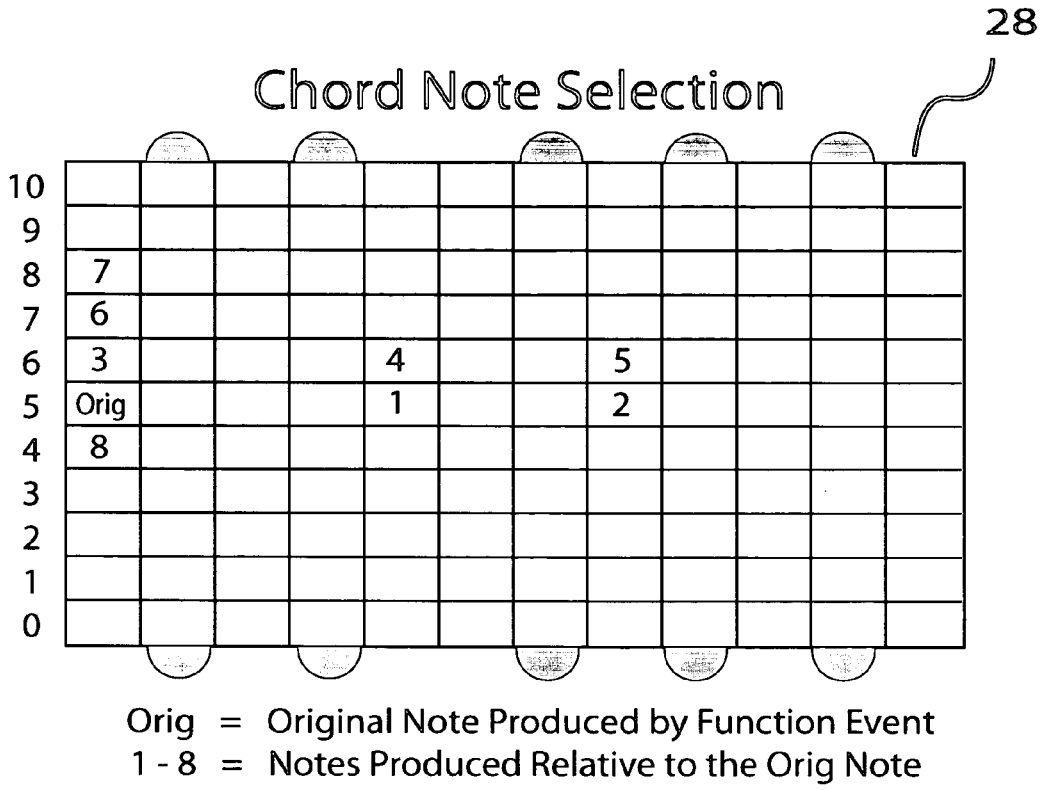
FIG. 8 shows a table used to design specific chords by selecting chord notes. The "Orig" note shown becomes the first note of the chord note played during playback and the other notes play relative to this note.
Figure 9:
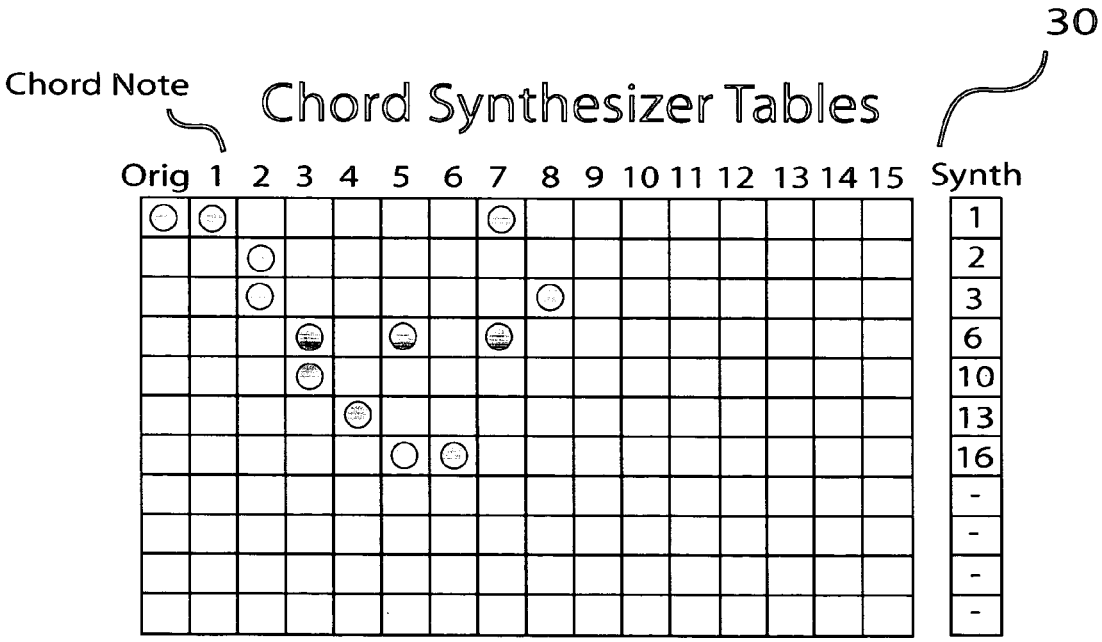
FIG. 9 is a table used to direct the FIG. 8 table chord notes to various synthesizers if so desired.

There are also tables that allow the musician to design their FIG. 8 chords 28. The chords 28 may contain many notes. The chords 28 are selected using the chord numbers in the main map. The chords 28 are sent to one or more synthesizers, and there are other tables FIG. 9 30 that allow the musician to select which synthesizers are used as a final destination. The output synths 26 main map selection chooses which of these tables to use.

Much mention has been made of switching to various mappings of the table functions. The tables shown in the patent figures represent one of hundreds of complete mappings of table data. The tables of FIGS. 3–10 may be ganged together in different, flexible, ways to give the user maximum utility. In one very helpful embodiment hundreds of tables in FIGS. 3–7 are all ganged together, and all duplicated for multiple keyboard input channels. This is useful during a performance if one or more musicians are playing different instruments and want independent control over their instruments. By using separate tables for each input instrument they may be ganged together and all switch simultaneously. Also there can be tables that support 6 guitar strings of 24 cells each, for a total of 144 cells in each table, for instance. This is helpful for MIDI guitar controllers. It also makes sense to keep the FIG. 10 Synths tables independent so sets of synth sounds may be updated separately, without changing anything else. It should be strongly emphasized that this is only one of many possible strategies to update the playing surface functions while one or more users are playing.

Figure 11A:
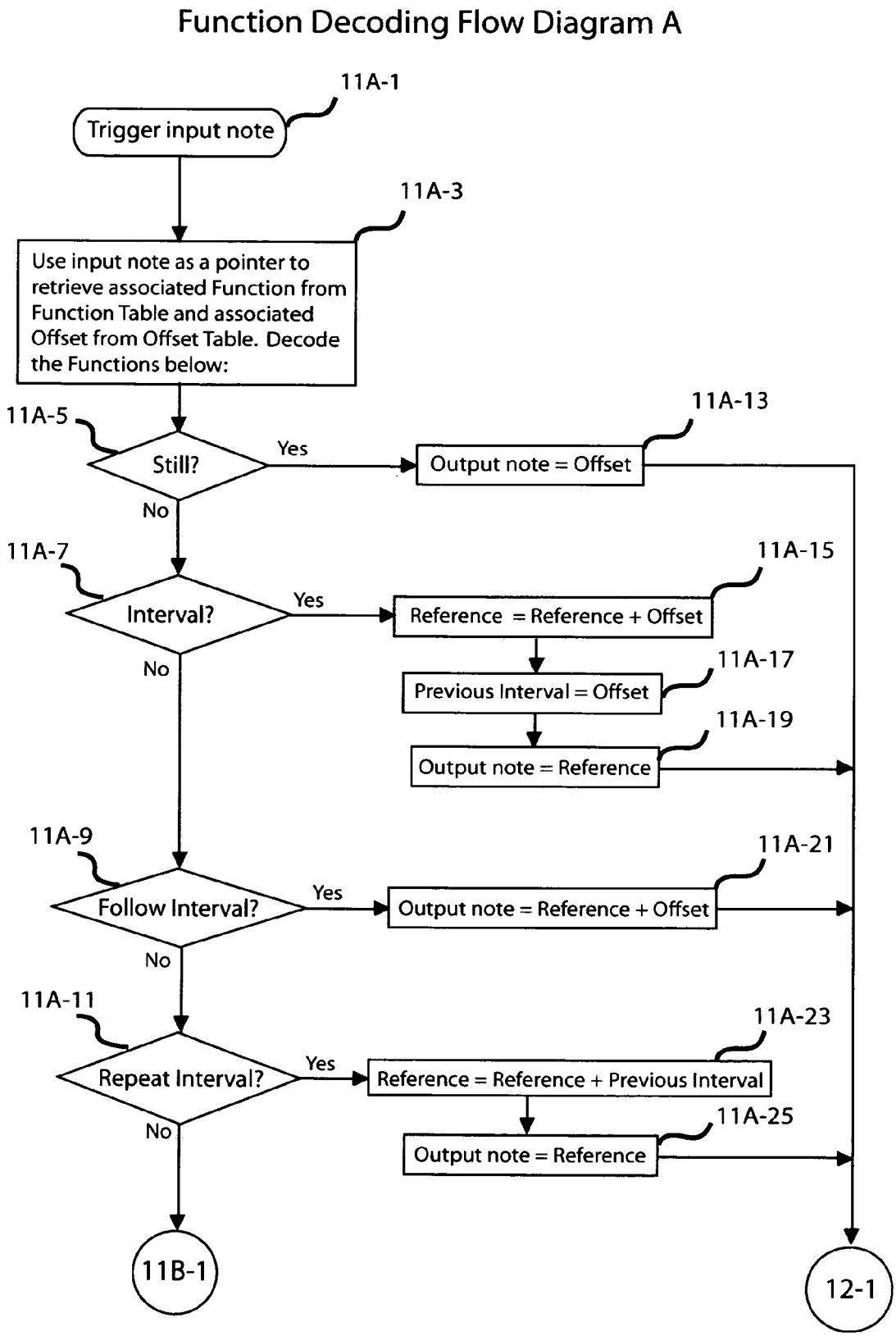
FIG. 11A is half of the Function decoding flow diagram.
Figure 11B:
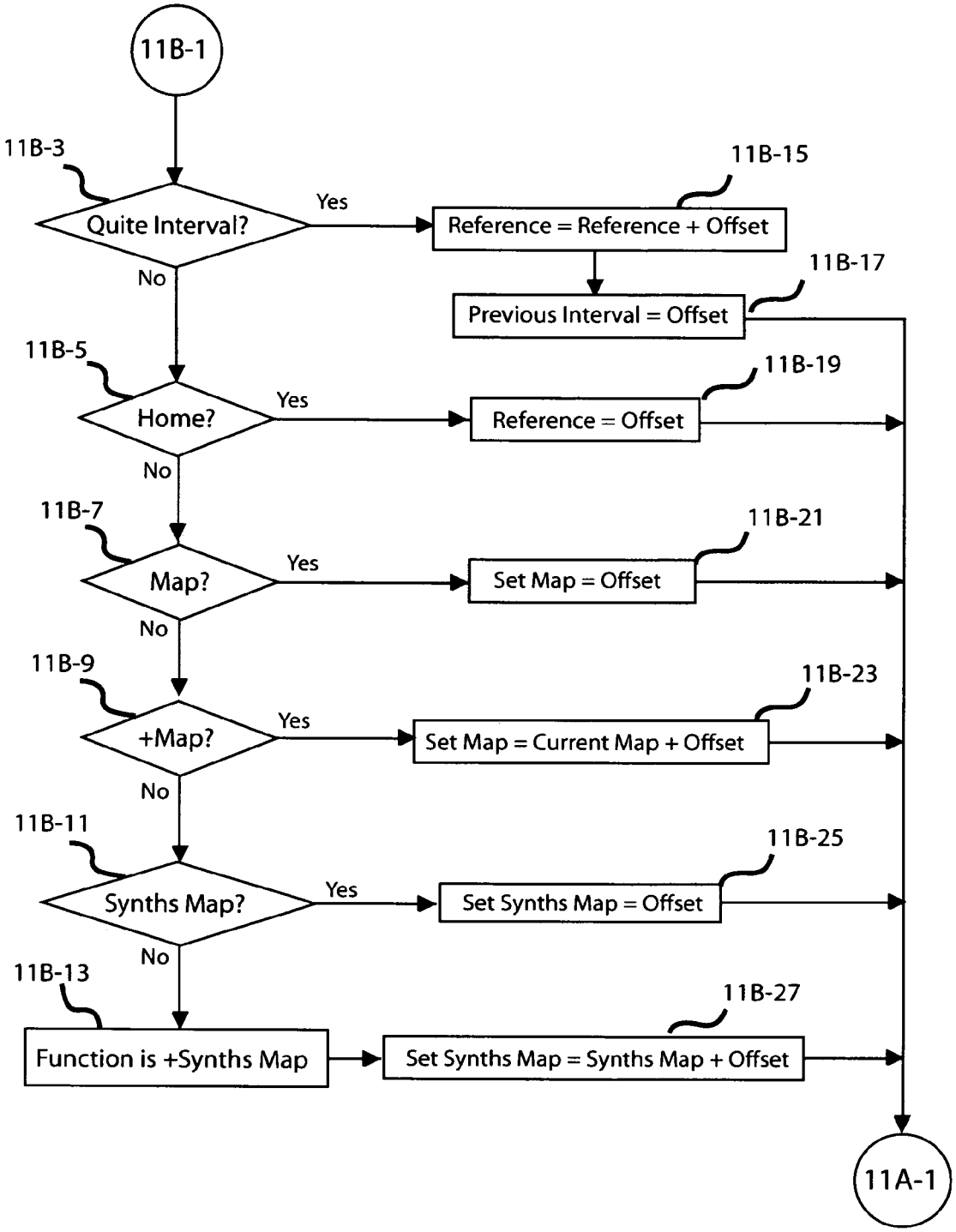
FIG. 11B is the other half of the Function decoding flow diagram.

FIGS. 11A, 11B, 12, 13, and 14 describe the program operation flow. FIGS. 11A and 11B describe the main input note Function decoding tree. As each new input note is triggered 11A-1 the associated Function table Function is decoded and is shown by the diamonds on the left hand column on both figures. The Offset data from the associated Offset table note pointer is used as data for subsequent calculations shown on the right hand column of boxes.

Referring to FIG. 11A the first function "Still" 11A-5 simply sets an output note variable that is equal to the Offset 11A-13. It provides no shifting and simply decodes a note. This produces traditional notes that remain stationary when played. The function "Interval" adds the Offset to the current Reference. This provides the actual shifting note calculation for the moving Reference. Next the Previous Interval is set equal to the Offset. This is necessary because subsequent "Repeat Interval" Functions need to remember the previous interval amount. Then as a last step to "Interval" the output note is set equal to the reference.

The Function "Follow Interval" decodes the output note variable to be equal to the current Reference plus the Offset. Notice this does not change the Reference, but simply produced a note relative to it. The function "Repeat Interval" shifts the Reference by the previous interval amount, then sets the output note variable to be equal to this newly shifted reference, thus repeating the previous interval, whatever it was.

FIG. 11B decodes functions that don't update the output note variable, or continue on to generate output notes of any kind. The lower right hand circle is labeled 11A-1, which means it loops back to decode another input note. The first function "Quiet Interval" does exactly the same as "Interval" described above, except that it does not set the Output note variable. This silently shifts the Reference.

The Function "Home" simply sets the Reference to a known value. The Functions: Map, +Map, Synths Map, and +Synths Map set, or increment the associated map array pointers. This way entire new mappings of functions, or synth settings can get instantly updated with a single input note event.

Figure 12:
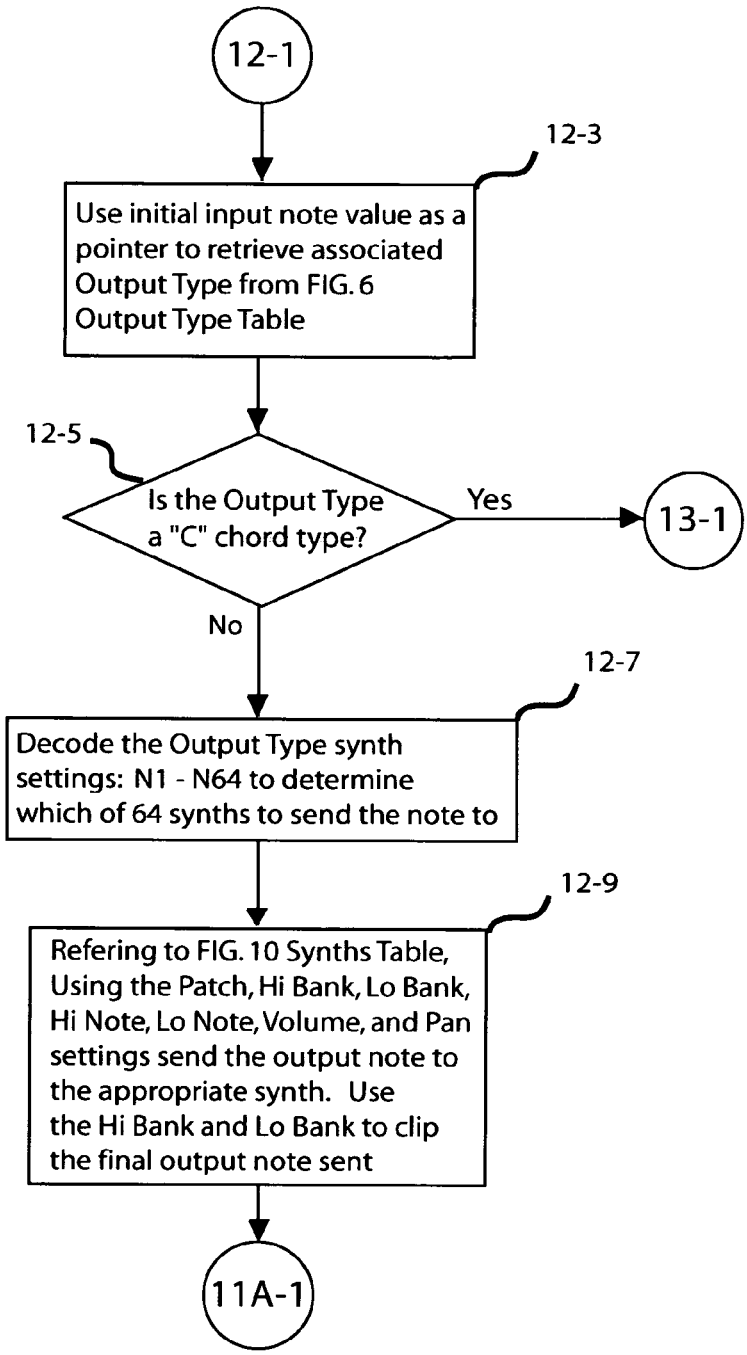
FIG. 12 is the output decoding flow diagram.

The bottom right circle of FIG. 11A branches to the top of FIG. 12. FIG. 12 decodes the output note using the initial input note pointer to point into the Output Type table to determine whether the output will be output as a note or chord. If it is to be output as a note it is sent to the appropriate synth 1–64. It sends the output notes to the synths after the synths table decoding. The program then continues to loop back to get another input note. If it is to be output as a chord it branches to 13-1.

Figure 13:
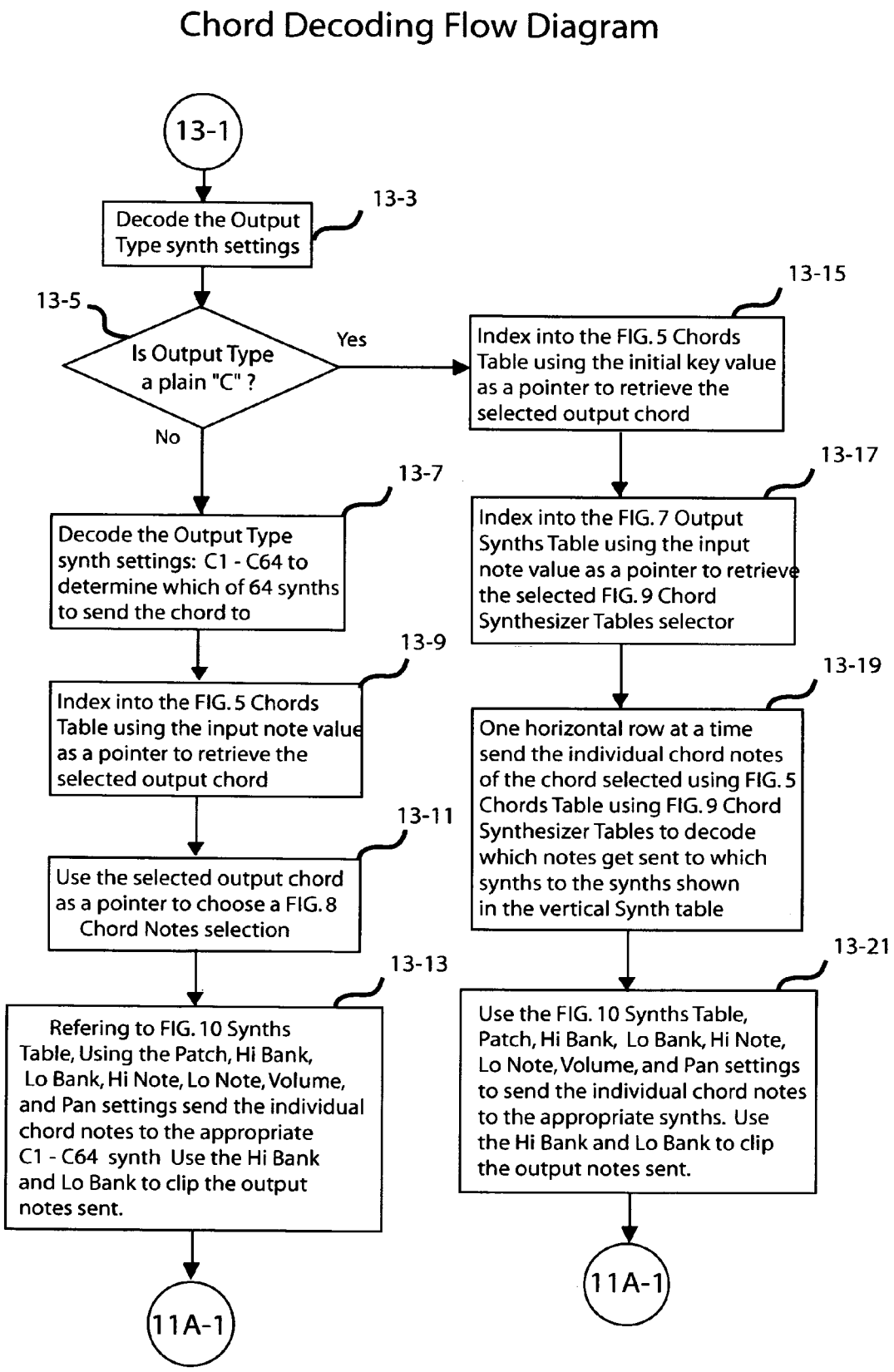
FIG. 13 is the chord decoding flow diagram.

FIG. 13 decodes the chord type and outputs appropriate chords. 13-5 determines if it is a plain "C" chord, and if not it uses the Chord Notes table to determine the individual chord notes then sends the output chord notes to the synths upon synths table decoding. Then the program loops back to retrieve the next note.

If the Output Type is a plain "C", then the software further decodes the chord using the Chord Synthesizer tables to send the chord notes to various synths during output while using the synths table for final decoding. Then the program loops back to retrieve the next note.

Figure 14:
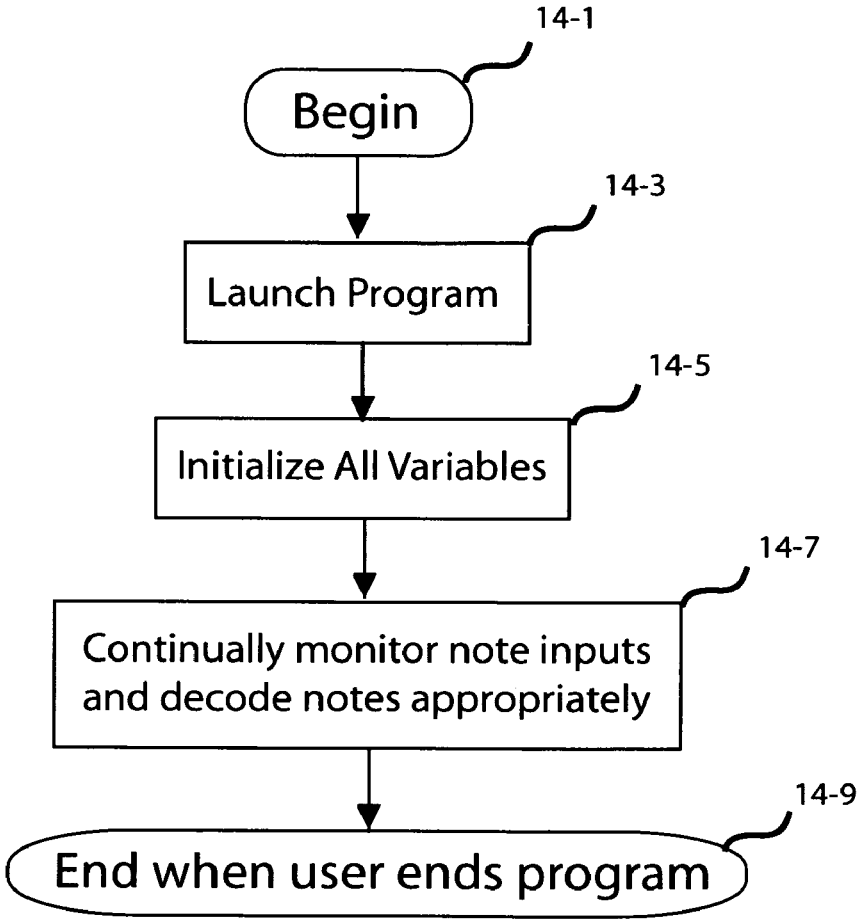
FIG. 14 is the high level decoding flow diagram.

FIG. 14 simply shows the high level program flow. There are many aspects to the program initialization and flow that have been left out, including details of program launch, initialization, editing, etc, because they are beyond the scope of the invention.

There are various methods for generating the final output notes. This invention applies to the two distinct processes of triggering musical notes, or generating musical note pitches by any arithmetic means. In the case of triggering musical notes the frequency of the resultant notes are often logarithmically scaled across the note range, just like tradition piano pitches. Using this approach the note pitches don't increase or decrease linearly, but they do increase or decrease. The invention apples to the process of generating or triggering final pitches that increase or decrease by any amount. Also the invention applies to the internal generation of pitches by any electronic means, whatsoever. The traditional concept of the musical key of a song being shifted need not be adhered to. Also, the moving reference need not be related to the musical key of a song. The output pitches need not produce notes that are related to any conventional use of a musical key. In the industry music is often produced by synthesizers that produce microtonal pitch shifts. The patent applies to a note reference that can shift to any frequency, whatsoever. The reference or references may shift by any amount produced by any arithmetic means. The invention not only applies to played note inputs, but also applies to the use of any type of input note values, whether they be calculated, or stored by any means.

An inherent disadvantage to this moving note approach is that if an interval function note is accidentally pressed that was not intended, it will send the song into a completely unexpected musical key or frequency. In particular, during a stage performance, this could be quite undesired. One way around this is to have a function that remembers interval steps and backs up to the last reference used, or backs up repeatedly until the desired reference location is found. Another solution is to use the home function to send the reference to a known location. Another disadvantage is that it may be more complicated for a seasoned musician to play two simultaneous melodies or sets of unrelated chords. This can be minimized by switching back and forth from using many Interval 12 producing key functions to using just a few at a time. It's also possible to have multiple interval musical references that operate independently. In the multiple reference case many of the map functions would need to be duplicated. Perhaps these could be called A, B, and C Functions, for instance.

CONCLUSION, RAMIFICATIONS, AND SCOPE

Having musical notes that effectively, dynamically move as they're played, open up tremendous possibilities for even the novice musician. Instantly, what was previously very complicated playing, becomes far simpler and much more fluid. Gorgeous note sequences become the norm. Songs that have previously been most easily confined to one musical key at a time, become intricate interwoven blends, even for the beginner. The ramifications are far reaching. Music university classes, music theory, keyboard classes, electronic guitar classes, may all drastically change. Even a person that has no music experience can now start playing with far greater joy. Kids will love the added capability. There may be a much larger market enjoyed by electronic instrument manufacturers, who will probably exhibit highly increased sales. The professional musician will be able to perform incredibly beautiful, complex music further adding to their existing talent.

SEQUENCE LISTING: not applicable

Relevant Prior Art Patents:

| | | | |
|---|---|---|---|
| 4,217,804 | Sep. 19, 1980 | Yamaga et al. | 84/1.03 |
| 4,708,046 | Nov. 24, 1987 | Kozuki. | 84/1.01 |
| 4,716,804 | Jan. 5, 1988 | Chadabe. | 84/1.01 |
| 5,281,754 | Jan. 25, 1994 | Farrett et al. | 84/600 |
| 5,357,048 | Oct. 18, 1994 | Sgroi. | 84/622 |
| 5,375,501 | Dec. 27, 1994 | Okuda | 84/609 |
| 5,418,322 | May 23, 1995 | Minamitaka. | 84/609 |
| 5,424,486 | Jun. 13, 1995 | Aoki. | 84/613 |
| 5,356,020 | Apr. 11, 1995 | Imaizumi. | 84/609 |
| 5,451,709 | Sep. 19, 1995 | Minamitaka. | 84/669 |
| 5,488,196 | Jan. 30, 1996 | Zimmerman et al. | 84/600 |
| 5,496,962 | Mar. 5, 1996 | Meier et al. | 84/601 |
| 5,502,274 | Mar. 26, 1996 | Hotz. | 84/601 |
| 5,612,501 | Mar. 18, 1997 | Kondoetal. | 84/609 |
| 5,619,003 | Apr. 8, 1997 | Hotz. | 84/615 |
| 5,714,705 | Feb. 3, 1998 | Kishimoto et al. | 84/609 |
| 5,739,453 | Apr. 14, 1998 | Chihana et al. | 84/609 |
| 5,883,325 | Mar. 16, 1999 | Pierce. | 84/601 |
| 5,864,079 | Jan. 26, 1999 | Matsuda. | 84/619 |
| 6,245,984 B1 | Jun. 12, 2001 | Aoki et al. | 84/611 |
| 6,639,141 B2 | Oct. 28, 2003 | Kay. | 84/609 |
| 6,642,444 B2 | Nov. 4, 2003 | Hagiwara et al. | 84/609 |
| 6,683,241 B2 | Jan. 27, 2004 | Wieder. | 84/600 |
| 6,696,631 B2 | Feb. 24, 2004 | Smith et al. | 84/645 |

I claim:

1. An improved method of generating dynamically moving musical notes comprising the steps of:

designating a musical instrument controller used as a source to generate position dependent input note values;

designating a computer to process said position dependent input note values and to generate output notes;

designating an output music synthesizer used as a destination for computer processed notes;

applying software that assigns musical interval jump values to said input note values that correspond to the musical instrument controller playing surface note positions;

applying software that provides a shifting musical reference stored in computer memory for tracking each played note;

and applying a three step software loop to each new musical controller incoming note that arithmetically adds the assigned said musical interval jump value to the current said musical reference yielding a sum, sends a note equating said sum to said music synthesizer, and updates said musical reference to be equal to said sum, with said software loop occurring on a note-by-note basis;

whereby played notes, instead of remaining stationary, effectively move, such that each new incoming note jumps its programmed interval relative to the previous output note and since each new note plays relative to the last note there is no need to learn twelve sets of musical patterns since the shapes of the played patterns are all the same in each of the possible twelve musical Keys, and, high speed, complex, intertwined, note sequences are easy for even a beginner, as are huge note jumps.

2. A method of claim 1 using said musical reference as a starting point value to generate subsequent notes that play relative to said musical reference, and do not update said musical reference comprising:

applying software that assigns arithmetic offsets to each individual said input note;

and applying a software algorithm that arithmetically adds an individual note offset to the current said musical reference to produce a note that is sent to said output synthesizer;

whereby the traditional musical Key of said subsequent notes dynamically changes on the fly, depending upon the said shifting musical reference, vastly improving user real time performance.

3. A method of claim 1 generating repetition of the last played said musical interval jump value comprising:

designating a computer memory location and storing the last played said musical jump value into said memory location;

designating said musical instrument controller input note position assigned to be the trigger for the repeat function;

and applying a three step algorithm that arithmetically adds the last played said interval jump value to the current said musical reference yielding a sum, sends said sum as a note to said music synthesizer, and updates said musical reference to be equal to said sum, with said software loop occurring on a note-by-note basis.

4. A method of claim 1 that does not output the final notes to the said output synthesizer, thereby creating silent said musical reference shifts.

5. A method of claim 1 that generates chords comprising the steps of:

applying software, user editable, chord tables for positioning multiple chord notes that sound relative to each other;

using numbers in the chord tables that arithmetically determine the relative output note positions of the chord notes, depending upon their relative table positions;

equating the chord root position to be equal to the said musical reference;

and sending the said chord notes to said output synthesizer based upon their said relative table positions.

6. A method of claim 1 that generates chords sent to multiple synthesizers comprising the steps of:

applying software, user editable, said chord tables for positioning multiple said chord notes that sound relative to each other;

using numbers in the chord tables that arithmetically determine the exact relative said output note positions of said chord notes, depending upon their said relative table positions;

equating the chord root position to be equal to the said musical reference; applying software, user editable, chord synthesizer tables that map said multiple chord notes to multiple said output synthesizers;

and sending said chord notes in sequence to said multiple synthesizers.

7. A method of claim 1 that also applies an offset to said sum.

8. A method of claim 1 that replaces said musical input controller with a file of prerecorded note events.

9. A method of claim 1 that stores output notes in a file to be subsequently output to a synthesizer.

10. A method of claim 1 that replaces said musical input controller with a file of prerecorded note events and replaces said output synthesizer with an output file.

11. A method of claim 1 combining said musical input controller, said computer, said software algorithms, and said output music synthesizer into one physical musical instrument.

* * * * *